United States Patent [19]

Brigham

[11] 4,429,216

[45] Jan. 31, 1984

[54] CONDUCTIVE ELEMENT

[75] Inventor: Alan Brigham, Sunnyvale, Calif.

[73] Assignee: Raychem Corporation, Menlo Park, Calif.

[21] Appl. No.: 224,453

[22] Filed: Jan. 12, 1981

Related U.S. Application Data

[63] Continuation-in-part of Ser. No. 102,621, Dec. 11, 1979, abandoned.

[51] Int. Cl.[3] ..... H05B 3/16; H05B 3/34

[52] U.S. Cl. ..... 219/528; 219/529; 219/543; 219/548; 219/549; 338/211; 427/121; 427/122; 427/180; 427/197; 427/202; 427/282; 427/299; 427/397.7; 428/87; 428/95; 428/96; 428/97; 428/195; 428/201; 428/204; 428/207; 428/208; 428/283; 428/286; 428/288; 428/289; 428/302; 428/303; 428/337; 428/339; 428/901

[58] Field of Search ..... 219/528, 529, 543, 548, 219/549; 338/211; 428/87, 90, 94, 95, 96, 97, 195, 201, 204, 207, 208, 283, 286, 288, 289, 302, 303, 337, 339; 427/121, 122, 180, 197, 202, 282, 299, 397.7

[56] References Cited

U.S. PATENT DOCUMENTS

| | | | |
|---|---|---|---|
| 1,872,581 | 8/1932 | Haroldson . | |
| 2,734,835 | 2/1956 | Florio et al. . | |
| 2,803,566 | 8/1957 | Smith-Johannsen . | |
| 2,891,228 | 6/1959 | Smith-Johannsen | 338/262 |
| 2,952,761 | 9/1960 | Smith-Johannsen | 219/19 |
| 2,991,257 | 7/1961 | Smith-Johannsen | 252/506 |
| 3,400,254 | 9/1968 | Takemori | 219/549 |
| 3,730,822 | 5/1973 | Lovell . | |
| 3,837,988 | 9/1974 | Hennen et al. | 428/97 |
| 3,839,134 | 10/1974 | Fujihara | 428/95 |
| 3,859,504 | 1/1975 | Motokawa et al. . | |
| 3,876,968 | 4/1975 | Barnes et al. | 338/211 |
| 3,900,654 | 8/1975 | Stinger | 428/214 |
| 3,952,116 | 4/1976 | Trenkler et al. | 427/122 |
| 4,061,898 | 12/1977 | Murray et al. | 219/549 |
| 4,084,031 | 4/1978 | Barsy | 428/95 |
| 4,115,917 | 9/1978 | Charon et al. | 219/549 |
| 4,158,078 | 6/1979 | Egger et al. | 219/528 |
| 4,169,911 | 10/1979 | Yoshida et al. | 428/36 |
| 4,185,137 | 1/1980 | Kinkel | 428/97 |
| 4,330,704 | 5/1982 | Jensen | 219/528 |
| 4,367,398 | 1/1983 | Strubl et al. | 427/122 |

FOREIGN PATENT DOCUMENTS

| | | |
|---|---|---|
| 2232558 | 4/1974 | Fed. Rep. of Germany . |
| 2401203 | 7/1975 | Fed. Rep. of Germany . |
| 2515897 | 10/1976 | Fed. Rep. of Germany . |
| 1243898 | 8/1971 | United Kingdom . |
| 1283444 | 7/1972 | United Kingdom . |
| 1332395 | 10/1973 | United Kingdom . |
| 1383162 | 2/1975 | United Kingdom . |

*Primary Examiner*—James C. Cannon
*Attorney, Agent, or Firm*—Lyon & Lyon

[57] ABSTRACT

An electrically conductive element comprises a support (perferably a flexible continous polymeric film) and fibrous material (preferably a spun glass fiber web) which is partially embedded in the support and partially protruding therefrom, the protruding fibrous material being part of a conductive layer comprising randomly distributed fibers having conductive material adhered thereto. The element can be prepared from a conductive composition containing conductive particles dispersed in a liquid medium (preferably an aqueous dispersion of carbon particles) by applying said composition to a substrate comprising a support and fibrous material which is partially embedded in one surface of the support and partially protruding therefrom, and then drying to evaporate the liquid medium. The elements are particularly useful as heating elements which comprise electrodes so that current can be passed through the conductive layer.

35 Claims, 1 Drawing Figure

CONDUCTIVE ELEMENT

CROSS-REFERENCE TO RELATED APPLICATION

This application is a continuation-in-part of my copending application Ser. No. 102,621 filed Dec. 11, 1979, and now abandoned.

This application is related to the said application Ser. No. 102,621 filed Dec. 11, 1979 and to my related application Ser. No. 102,576, filed Dec. 11, 1979, Elements Comprising Fibrous Materials, both of which are incorporated by reference.

BACKGROUND OF THE INVENTION

1. Field of the Invention

This invention relates to conductive elements e.g. heating elements, comprising a conductive composition deposited onto a support.

2. Discussion of the Prior Art

Conductive elements comprising laminates of a porous electrically conductive layer composed of electrically conducting particles bonded together in an open continuous structure, electrodes on the conductive layer in electrical contact therewith and at least one layer covering each surface of the conductive layer are disclosed in U.S. Pat. No. 2,952,761 to R. Smith-Johannsen. Numerous methods for the preparation of similar elements for use as heaters are disclosed in the prior art. See, for example, U.S. Pat. Nos. 2,803,566, 2,891,228 and 2,991,257 all to R. Smith-Johannsen, 3,400,254 to Takemori, 3,876,968 to R. D. Barnes et al. 3,900,654 to J. J. Stinger and 4,169,911 to Yoshida et al. The disclosures of the above patents are incorporated by reference herein.

In the prior art processes the conductive composition is applied to a substrate, for example, asbestos fiber mat, glass fabric or thermoplastic film. The structure is then generally laminated to one or more outer layers. When the conductive composition is an aqueous based dispersion of conductive particles, preferred for reasons of economy and safety, as in above-mentioned U.S. Pat. No. 2,952,761, the substrate used in actual practice has generally been an asbestos fiber mat, although use of other substrates is suggested in this patent. When the conductive composition is one containing an organic solvent medium, a wider range of substrates, including thermoplastic films, can be used. For example, in U.S. Pat. No. 3,900,654, a heating element is prepared from a thermoplastic film support with an adherent conductive layer of an electrically conductive material containing carbon black dispersed in a fluorocarbon elastomer. It is mentioned that the support can be composed of a layer of the polymer adhered to another material such as a fibrous sheet. It is also mentioned that the conductive elastomer can be applied from a liquid coating composition in which the elastomer is dispersed in an organic solvent or in water.

Conductive elements prepared by processes of the type described above are not entirely satisfactory. While a very useful product can be made by impregnating a uniform asbestos fiber mat with an aqueous dispersion of conductive particles, careful precautions are necessary in handling products including asbestos fibers, and attempts to replace the uniform asbestos fiber mat by other uniform fiber mats have not yielded satisfactory products. More particularly, it is often difficult to obtain good adhesion of the conductive particles to the substrate coated, particularly when the substrate is flexible and/or is not adequately wetted by the liquid composition comprising conductive particles. If wetting is inadequate, so-called "mud-cracking" of the conductive layer can take place when the liquid composition is dried, resulting in unstable electrical properties. Even if satisfactory adhesion can be obtained initially, it is difficult to make a product which has stable electrical properties over an extended period of use, especially when the element is subject to flexing.

SUMMARY OF THE INVENTION

I have now discovered that improved electrically conductive elements comprise a support and randomly distributed fibers having first portions which protrude from the support and which have solid electrically conductive material adherent thereto, thus forming an electrically conductive layer, and second portions which are embedded in the support and are substantially free of electrically conductive material adherent thereto. The presence of the partially protruding fibrous material improves adhesion of the conductive layer to the support and is particularly useful in improving the electrical stability of elements which are subject to flexing.

In one aspect, the invention provides an electrically conductive element comprising a support and fibrous material which is partially embedded in the support and which partially protrudes therefrom, at least a portion of the fibrous material which protrudes from the support forming a part of a conductive layer comprising randomly distributed fibers having electrically conductive material adhered thereto. Preferred conductive elements of the invention are heating elements which further comprise at least two spaced-apart electrodes which can be connected to a source of electrical power and which when so connected cause current to pass through the conductive layer.

In another aspect the invention provides a process for the preparation of an electrically conductive element which comprises depositing a liquid composition comprising electrically conductive particles onto the protruding fibers of a substrate which comprises a support and randomly distributed fibers having first portions which protrude from the support and second portions which are embedded in the support, the support and the portions of the fibers embedded therein being substantially impervious to the liquid composition; and solidifying the liquid composition.

DETAILED DESCRIPTION OF THE INVENTION

Figure 1:
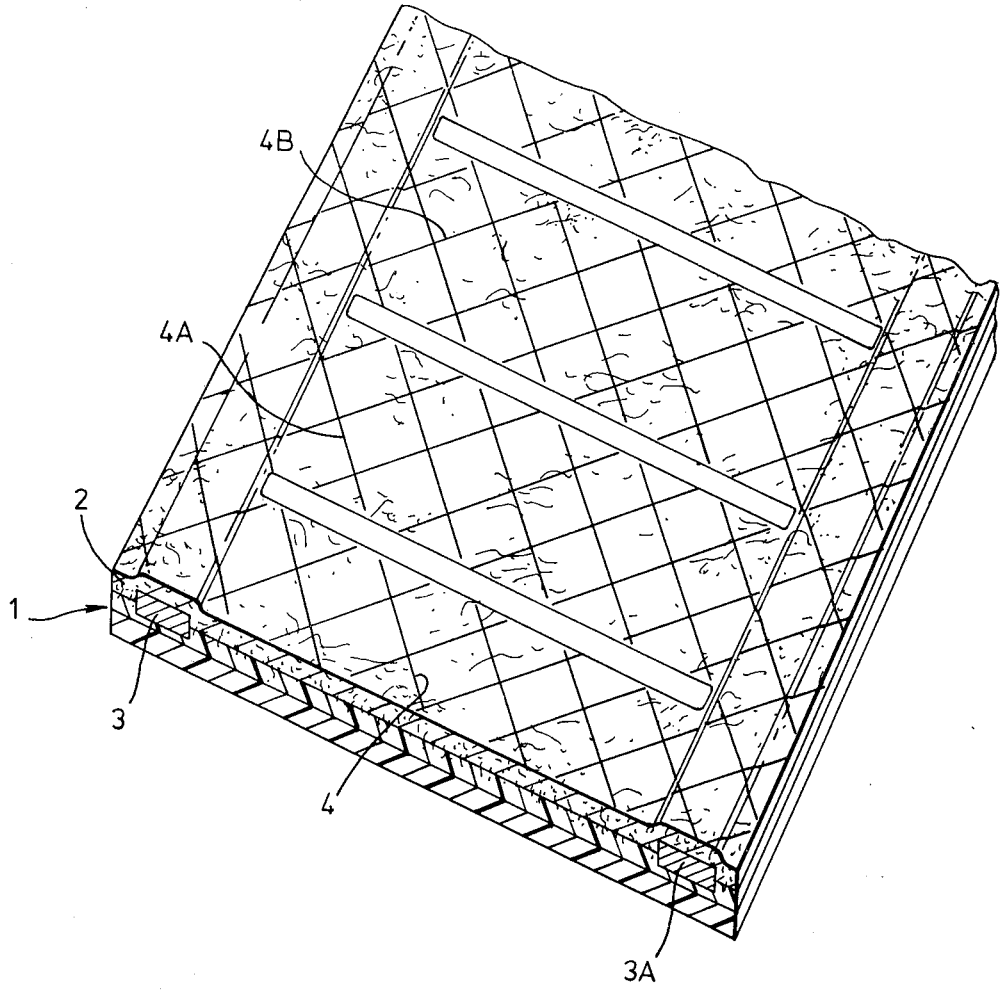
FIG. 1 shows an isometric view, partly in cross-section, of a heating element in accordance with a preferred embodiment of this invention.

The support of the conductive element of this invention can be flexible or rigid and can be for example a film, block, slab or other shaped article. Preferably the support is sufficiently flexible for the element to be bent without breaking through an angle of at least 90° around a mandrel having a diameter of 15 cm or less, e.g. 1.25 cm. It is also preferred that, when the support is flexible, the neutral bending axis of the element passes through the conductive layer; such preferred elements may for example further comprise a flexible layer of electrically insulating material remote from the support.

A wide variety of supports can be used in this invention. Often the support will comprise at least one continuous film of a polymeric material. Since the fibrous material must be secured to the support, it is preferred that part of the fibrous material is embedded in a layer of a polymeric composition which provides at least one surface portion of the support. The support can be entirely of a single composition, with the fibrous material partially embedded in one surface portion thereof. For example, the support can be of a thermoplastic material which when heated softens so that fibers can be impressed into the surface. Alternatively and preferably, the support can be a composite structure comprising a backing, preferably a continuous layer of a film-forming polymeric composition, e.g. a polyester, and an adherent layer of a polymeric composition e.g. a polyolefin, which is preferably also a film-forming composition, in which the fibrous material is partially embedded. Preferably the adherent layer has, at least when the fibers are being embedded in the support, a softening point lower than the backing, so that there is no danger of the support losing its structural integrity when the adherent layer is heated to a temperature which permits fibrous material to become embedded in it. The adherent layer may comprise a single polymer or a mixture of polymers, for example an adhesive. The adhesive can be a partially cured thermosetting resin, e.g. a B-stage polyester resin, which is fully cured after the fibers have been partially embedded in it; alternatively it can be a hot melt adhesive.

Suitable polymeric materials for the backing and any layer adherent thereto include polyethylene, polypropylene, polyvinyl chloride, polyvinyl fluoride, polyvinylidene chloride, polyvinylidene fluoride, polytetrafluoroethylene, polyethylene terephthalate, polyethylene sebacate, polyhexamethylene adipamide, poly-epsilon-caprolactam, polymethyl methacrylate, polyepoxides, phenol-formaldehyde resin, rubber, ethylene-propylene rubber, ethylene-propylene-diene terpolymer rubber, acrylonitrile-butadiene-styrene terpolymers, and other homo-, co- and terpolymers. A preferred support is a flexible laminate of polyethylene terephthalate backing with a polyethylene adherent film laminated thereto.

The support can be substantially free of all fibers, or at least of randomly distributed fibers, except of course for the embedded portions of the fibers protruding therefrom, but fiber-reinforced polymeric films can be used as supports or components of supports. Often the support will be substantially impermeable to water and/or will be an electrical insulator.

The support can also be a woven or non-woven fibrous material. In this case the conductive mix which is applied to the substrate may penetrate the support to a limited extent. However, the protruding fibers should provide, by reason of their chemical and/or their physical properties such as size and packing density, a layer which can be distinguished from the support and which will retain a greater proportion of the conductive mix than the support. Thus if both the support and the protruding fibers consist essentially of randomly distributed fibers, and the fibers in the support are the same as the protruding fibers, the packing density of the fibers in the support should be substantially greater than the packing density of the protruding fibers.

Suitable fibers for the fibrous material include glass fibers, which are preferred and which preferably have an average diameter of 3 to 50 microns; cotton, paper and other cellulosic fibers; ceramic fibers; and the like. The fibers will generally be chemically different from the support but both may be composed of electrically insulating materials. The fibrous material preferably consists essentially of randomly distributed fibers as in a non-woven fibrous mat, especially a random spun web of glass fibers. When a non-woven fibrous mat is used, its thickness is usually at least 0.05 mm, preferably 0.07 to 0.6 mm, especially 0.13 to 0.25 mm. The fibrous material need not be a coherent web or fabric; for example individual fibers can be partially embedded in the support by a flocking process. Each of the fibers (whether applid as a non-woven web or otherwise) can have a plurality of embedded portions and/or a plurality of protruding portions. Thus the protruding portions of the fibers can be in the form of loops and/or free ends.

The fibrous material is preferably partially embedded in the surface of the support so as to provide a fibrous layer in which, in at least the outer section of the layer, i.e. the section providing the surface of the layer remote from the support, and preferably throughout the layer, at least a substantial proportion, and preferably substantially all, of the fibers are randomly distributed, so that at least in the absence of the conductive composition, they define a plurality of randomly distributed voids. It is believed that, at least in some cases, the fibers, in the absence of the conductive composition, have a sufficient degree of free movement relative to each other to permit changes in the shapes of the voids when the conductive composition is applied to the layer during preparation of the element.

The conductive material adhered to the randomly distributed fibers of the fibrous material can be deposited thereon in any appropriate way, but is preferably applied to the fibers in the form of a composition comprising conductive particles dispersed in a liquid medium. The liquid medium is preferably water or an organic liquid which is subsequently evaporated, preferably with the aid of heat, leaving the conductive particles adhered to the fibers as a conductive coating on the fibers, which coating preferably has an average thickness of from about 10 to about 200 microns. However, the invention also contemplates the use of liquid media which at least in part solidify, either by cooling from an elevated temperature at which the liquid composition is applied and/or by chemical reaction after the liquid composition has been applied. The liquid compositions are preferably substantially free of reinforcing fibers. More than one coating of the liquid composition can be deposited on the fibrous material; the first coating can be, but preferably is not solidified, such as by drying, before the second coating is deposited. It is preferred that all coatings be solidified at once. The compositions applied can be the same or different.

The conductive material is preferably deposited on the fibers so that the conductive layer has a plurality of randomly distributed voids therein, preferably throughout the conductive layer's thickness. The voids can be open and/or closed cells. It is also preferred that there are randomly distributed fibers throughout the thickness of the conductive layer.

A particularly preferred liquid composition comprises particles selected from the group consisting of graphite, carbon black and mixtures thereof dispersed in an aqueous medium containing a suitable binder for said particles. Such compositions are disclosed in U.S. Pat. No. 2,803,566 to Robert Smith-Johannsen the disclosure of which is incorporated herein by reference. The conductive compositions disclosed in this patent comprise an aqueous dispersion of particles of electrically conductive material and an alkali-stabilized colloidal silica in the form of dispersed particles having a particle size of 1 to 100 millimicrons. The conductive particles therein are preferably carbon black. Other conductive compositions wherein the conductive particles are graphite and/or carbon black are well known and can be used in preparing the conductive element of this invention.

When the conductive material is applied as an aqueous dispersion, and especially when the fibrous material is glass, the fibrous material can advantageously be washed with an aqueous solution containing a cationic wetting agent before applying the dispersion. The wetting agent conditions the surface of the fibers and promotes adhesion at the interface between the fibers and the aqueous dispersion of anionic conductive particles.

The liquid coating compositions can be applied by conventional techniques, for example by painting, spraying, printing, silk screen printing, gravure printing, and the like. Printing the conductive composition onto the fiber-modified surface permits accurate control of the amount of composition applied, and is a preferred method for producing the conductive element of this invention. The coating composition can be applied substantially uniformly over the fiber-modified surface of the support or different electrical properties can be conferred on different parts of the element by applying the conductive composition in a predetermined pattern onto the surface and/or by varying the conductive composition used in different areas. This is especially useful for heating elements. The heat capacity of a heater is generally expressed in terms of power output per unit area of the heater and is often referred to as the watt density. Watt density depends upon the nature and concentration of the conductive particles, the type and amount of binder, the ratio of binder to conductive particles, and the thermal and processing history of the composition. The resistance of the conductive layer in the conductive elements of this invention is preferably in the range from about 10 to about 150,000 ohms per electrical square. The power output of heating elements depends on the voltage applied.

Non-uniform application of the liquid composition can be used to produce heating elements having a desired non-uniform heat output. Non-uniform printing is also useful for the production of heaters which comprise a number of heating panels, each connected to the electrodes but separate from each other, such as panels applied to the substrate in a discontinuous pattern, so that if a burn-out or other fault should occur, it cannot propagate along the heater. If the panels are separated only by a short distance, the heat output of the heater can be substantially uniform.

In the heating elements of this invention, at least two electrodes are in electrical contact with the conductive layer. The electrodes can be placed on the surface of the support before the fibrous material is partially embedded into the surface of the support. During the step of embedding the fibrous material the electrodes can also become partially embedded in the support. The fibrous material can be applied over the electrodes as well as the exposed surface of the support, in which case the liquid composition penetrates through the fibrous material into contact with the electrodes. Alternatively, the electrodes can be placed on top of the protruding fibers of the substrate prior to application of the liquid composition. It is also possible to place the electrodes in contact with the conductive layer after it has been formed; the electrodes can be bonded to the conductive layer using an electrically conductive adhesive, such as an adhesive comprising an epoxy or polyester resin containing conductive particles such as graphite, carbon black or powdered metal.

The electrodes are preferably strip electrodes of plain or expanded metal, for example, nickel, copper, silver, platinum, aluminum, or stainless steel, etc.. Electrodes of expanded nickel or copper are particularly preferred. Mesh electrodes can also be used. Other highly conductive materials can be used, for example highly conductive polymer compositions containing carbon black and/or graphite to impart sufficient conductivity. Wire conductors can be used if sufficient contact with the conductive layer is obtained. One way of achieving this is to paint over the wire and adjacent conductive layer with a conductive paint such as silver or aluminum paint.

When the electrodes are connected to a source of electrical power, current flows through the conductive layer, producing resistive heating. The source of electrical power can, for example have an electrical potential of about 12 to about 600 volts. Preferably the potential is 110 or 220 volts for many uses of the heating element. The operating temperature of the heating element can be up to about 150° C. and even higher. Since the support and fibrous material must be able to withstand the heat generated by the heater, the operating temperature must be considered in selecting the support and fibrous material.

In the novel elements, there may be a conductive layer secured to more than one surface of a support. For instance, when the support is in the form of a sheet, both faces of the sheet may have randomly distributed fibers partially protruding therefrom and partially embedded therein, the first portions of the fibers which protrude from the support surfaces and having solid electrically conductive material adherent thereto, thus forming more than one electrically conductive layer. The elements can also be laminated to each other or to other conductive elements to create layered structures. In one preferred embodiment, the element also comprises an electrically insulating polymeric layer which is secured to the surface of the conductive layer remote from the support, preferably so that the neutral bending axis of the element passes through the conductive layer. There may be an insulating layer secured to the surface of each conductive layer remote from the support in an embodiment where there is a conductive layer secured to more than one surface of a support. Preferably the insulating layer comprises a backing and an adherent layer (as described above for the support), which is laminated to the element under heat and pressure so that the coated protruding fibers become embedded in the adherent layer. The adherent layer may be such that it flows to fill substantially all the voids in the conductive layer.

The conductive elements of this invention are useful not only as heaters, but also for other uses, including uses in which electrodes are unnecessary, for example as microwave detectors, RFI/EMI (radio frequency interference/electromagnetic interference) shielding in stereo systems and the like, carbon electrodes for electrochemical processes, such as waste water treatment and electroplating, as printed circuit boards, and as static electricity bleeders, e.g. for carpets, conveyor belts, belt sanders, etc., or the like.

The following example illustrates a preparation of a heating element in accordance with this invention.

EXAMPLE

A conductive particle composition is prepared by the following procedures.

A conductive mix is prepared by mixing 260 parts of acetylene black having an average particle size of 42 millimicrons, commercially available as Shawinigan acetylene black, and 140 parts of oil furnace carbon black having an average particle size of 30 millimicrons, commercially available as Vulcan XC-72, in sufficient water to give the composition a 19% solids content. The conductive mix is then allowed to age at least one day.

A first premix is prepared by blending the following ingredients in a homogenizing high shear mixing tank:

200 parts aqueous colloidal silica sol containing 40% silica, commercially available as Ludox HS-40, 59 parts acrylic latex adhesive comprising a copolymer of ethyl and butyl acrylate, commercially available as AS-61X, Ammonium hydroxide to adjust the pH to about 9.9 and 17 parts deionized water.

To this mixture is added 128 parts of deionized water containing 3 parts of dicyandiamideformaldehyde condensate, which is a cationic wetting agent commercially available as Warcofix. The first premix is then allowed to age overnight.

Binder A is prepared by mixing 204 parts of first premix with 68 parts of bentonite clay. The resulting mix is permitted to age at least 24 hours.

Binder B is prepared by mixing 200 parts of the aqueous colloidal silica sol, 126 parts of the acrylic resin adhesive and ammonium hydroxide in an amount to adjust the pH to about 9.9. To this mixture is then added 88 parts of deionized water containing 5 parts of the cationic wetting agent. The mixture is permitted to age 24 hours.

The conductive particle composition is prepared by mixing 50 parts of Binder A, 50 parts of Binder B and then adding 100 parts of conductive mix. The resulting mixture is then ready for use.

Two strips of expanded nickel, 0.5 inches wide and 0.005 inches thick, are placed parallel to the edges along the length of the polyethylene surface of a flexible strip comprising a laminate of polyethylene terephthalate 5 mils thick, and polyethylene, 2 mils thick. Fibrous material in the form of a random spun web, 3 mils thick, of glass fibers, having an average diameter of 3.8 microns, is placed over the polyethylene surface and the nickel strips and is embedded in the polyethylene layer by application of heat and pressure. The surface is then washed to remove loose fibers using a solution of 99.8 parts deionized water, 0.1 parts of a cationic charge modifying agent, Warcofix, and 0.1 parts of a nonionic surfactant, commercially available as Triton CF10.

The conductive composition is silk screen printed onto the surface using a 200 mesh screen. Two coats of the composition are applied to ensure complete coverage. The second coat is applied before the first coat is dried. The conductive composition makes electrical contact with the two metal strip electrodes and extends completely over the area between the metal strips. The composition is allowed to dry and a top layer of a flexible laminate of polyethylene terephthalate and polyethylene film is laminated to the conductive composition and support. The heating element has a resistance of about 500 ohms per square, and when connected to 110 volt supply has a watt density of about 24 watts per square.

FIG. 1 illustrates the heating element prepared in accordance with a preferred embodiment of this invention. In FIG. 1, a flexible support, 1, consists of a laminate of polyethylene terephthalate and polyethylene. A random spun web of glass fibers, 2, is partially embedded in the polyethylene surface of the support as described in the above example. Copper strip electrodes, 3 and 3*a*, are placed on the surface prior to embedding the web. An aqueous conductive particle composition is then printed onto the surface in a pattern which is continuous over the electrodes and in the form of panels, 4, 4*a*, 4*b*, over the fibrous material of the web in the area between the electrodes. The panels can be positioned as far apart as desired to create heat/nonheat areas on the surface of the support. When uniform heat along the length of a heater is desired the conductive composition can be applied substantially uniformly over the fibrous material. However, it is also possible to provide relatively uniform heat along the length of the heater by printing discontinuous panels as above with minimal spacing between them. The discontinuity prevents propagation of a fault condition from one panel to the next. As is well known in flat flexible heaters of this type, if a fault or burn out occurs in the heater, the fault tends to propagate along the length of the heater.

The individual panels of a heater can be printed with conductive compositions of different watt densities. In this way the amount of heat generated in the separate panels will vary. By appropriate selection of the conductive composition, the heat generated along the length of the heater can be varied in a preselected manner. It is also possible to apply more than one coat of the conductive composition either uniformly along the heater or in a preselected pattern, thereby also selectively controlling the heat that will be generated along the heater. If more than one coat of conductive composition is applied, either over the entire surface of the heating element or any desired portion thereof, the second and successive coats should preferably be applied before the immediately preceding coat has dried. As will be readily apparent, shapes other than panels can be printed onto the fiber-modified surface of the support. Also, the shape of the heater can be varied by selecting a support of the desired shape. Generally, a flexible support in the form of a strip with electrodes positioned relatively close to and parallel to the edges will be used. However, nonflexible supports can be used, if desired. Also, both flexible and non-flexible supports in shapes other than strips can be used.

It is also possible to partially embed fibrous material to more than one surface of the support. Conductive elements of this invention can be laminated together creating a layered structure if desired. As will be readily apparent, different conductive compositions and/or different printed patterns of conductive composition can be applied to create the desired effect.

What is claimed is:

1. An electrically conductive element which comprises (a) a support which is a flexible continuous film of polymeric material; and (b) randomly distributed fibers having first portions which protrude from the support and which have solid particulate electrically conductive material deposited thereon and adherent thereto, thus forming an electrically conductive layer, and second portions which are embedded in the support and are substantially free of electrically conductive material adherent thereto.

2. An element according to claim 1 wherein the support is a laminate comprising a first continuous layer of a polymeric film-forming composition and a second layer of a second polymeric composition having a lower softening point than the first polymeric composition, the fibers being partially embedded in the second layer.

3. An element according to claim 2 wherein the first polymeric composition comprises a polyester and the second polymeric composition comprises a polyolefin.

4. An element according to claim 2 wherein the second layer is a hot melt adhesive.

5. An element according to claim 1 wherein the support is a laminate comprising a first continuous layer of a polymeric film-forming composition and a second layer of a second polymeric composition which comprises a thermoset resin.

6. An element according to claim 1 wherein the support and the fibers are composed of electrically insulating material, and the element further comprises an electrically insulating layer of polymeric material secured to the surface of the fibers remote from the support.

7. An element according to claim 6 which is flexible and whose neutral bending axis passes through the conductive layer.

8. An element according to claim 1 wherein the fibers are in the form of a non-woven fibrous mat which is partially embedded in the support.

9. An element according to claim 8 wherein the fibrous mat is 0.07 to 0.6 mm thick.

10. An element according to claim 1 wherein the fibers comprise glass fibers.

11. An element according to claim 10 wherein the fibers have an average diameter of 3 to 50 microns.

12. An element according to claim 1 wherein the support is in the form of a sheet, both faces of the sheet having randomly distributed fibers partially protruding therefrom and partially embedded therein, the first portions of the fibers which protrude from the support surfaces having solid electrically conductive material adherent thereto, thus forming more than one electrically conductive layer.

13. An element according to claim 12 wherein the support and the fibers are composed of electrically insulating material, and the element further comprises an electrically insulating layer of polymeric material secured to the surface of each conductive layer remote from the support.

14. An element according to claim 1 wherein the conductive layer has a plurality of randomly distributed voids therein.

15. An element according to claim 1 which further comprises an electrically insulating layer of polymeric material comprising a backing layer of a continuous film-forming polymeric composition and an adherent layer of a polymeric composition having a softening point which is lower than either the backing layer or the support, the adherent layer being secured to the surface of the conductive layer remote from the support and filling substantially all the voids in the conductive layer.

16. An electrically conductive element according to claim 1 which further comprises a layered structure having a plurality of electrically conductive elements laminated together.

17. An element according to claim 1 wherein the support is substantially impermeable to water.

18. An element according to claim 1 wherein the conductive layer is one obtained by depositing on the fibers an aqueous dispersion of conductive particles, and removing the water from the dispersion.

19. An element according to claim 18 which further comprises a cationic wetting agent at the interface between the fibers and the aqueous dispersion of conductive particles.

20. An element according to claim 1 wherein the solid conductive material is selected from the group consisting of carbon black, graphite and a blend of carbon black and graphite.

21. An element according to claim 1 which further comprises at least two spaced-apart electrodes which can be connected to a source of electrical power and which when so connected cause current to pass through the conductive layer.

22. An element according to claim 1 wherein the conductive layer has a resistance of 10 to 150,000 ohms per electrical square.

23. A process for the preparation of an electrically conductive element which comprises (a) depositing a liquid composition comprising an aqueous dispersion of electrically conductive particles onto the protruding fibers of a substrate which comprises a support and randomly distributed fibers having first portions which protrude from the support and second portions which are embedded in the support, the support and the portions of the fibers embedded therein being substantially impervious to the liquid composition; and (b) drying the aqueous dispersion.

24. A process according to claim 23 wherein the support is a flexible continuous film of hydrophobic polymeric material.

25. A process according to claim 24 which further comprises washing the substrate with an aqueous solution comprising a cationic wetting agent before applying the dispersion.

26. A process according to claim 23 wherein the liquid composition is substantially free of reinforcing fibers.

27. A process according to claim 23 wherein the liquid composition is applied to the substrate by a printing process.

28. A process according to claim 27 wherein the liquid composition is applied to the substrate by silk screen printing.

29. A process according to claim 27 wherein the liquid composition is applied to the substrate in a discontinuous pattern.

30. A process according to claim 23 wherein the randomly distributed fibers comprise a non-woven fibrous mat of glass fibers having an average diameter of 3 to 50 microns, the mat having a thickness of 0.07 to 0.6 mm.

31. A process according to claim 23 which further comprises placing at least two spaced-apart electrodes on the protruding fibers of the substrate prior to applying the liquid composition, and applying the liquid composition onto the electrodes and the fibers, whereby after step (2) connection of the electrodes to a source of electrical power causes current to flow through the conductive element.

32. A process according to claim 23 which further comprises placing at least two spaced-apart electrodes on the support before embedding the second portions of the randomly distributed fibers in the support, the randomly distributed fibers extending over the electrodes, and applying the liquid composition onto the protruding fibers, whereby after step (2) connection of the electrodes to a source of electrical power causes current to flow through the conductive element.

33. A process according to claim 23 wherein more than one coating of the liquid composition is deposited, the first coating being solidified before the second coating is deposited.

34. A process according to claim 23 wherein more than one coating of the liquid composition is deposited, all coatings being solidified at once.

35. A process according to claim 23 wherein the conductive particles are selected from carbon black, graphite and mixtures of carbon black and graphite, and the liquid composition comprises, as binder for said particles, an alkali-stabilized colloidal silica in the form of dispersed particles having a particle size of 1 to 100 millimicrons.

* * * * *